US011787144B2

(12) United States Patent
Barnett

(10) Patent No.: US 11,787,144 B2
(45) Date of Patent: Oct. 17, 2023

(54) SYSTEM AND METHOD FOR CUTTING SHEETS FOR USE IN THE PRODUCTION OF BOXES

(71) Applicant: Canadian Corrugated Systems, Toronto (CA)

(72) Inventor: Michael Joseph Barnett, London (CA)

(73) Assignee: CANADIAN CORRUGATED SYSTEMS, Toronto (CA)

( * ) Notice: Subject to any disclaimer, the term of this patent is extended or adjusted under 35 U.S.C. 154(b) by 0 days.

(21) Appl. No.: 17/237,440

(22) Filed: Apr. 22, 2021

(65) Prior Publication Data

US 2021/0362455 A1 Nov. 25, 2021

Related U.S. Application Data

(60) Provisional application No. 63/027,504, filed on May 20, 2020.

(51) Int. Cl.

| | |
|---|---|
| ***B31B 50/20*** | (2017.01) |
| ***B31B 50/14*** | (2017.01) |
| ***B31B 50/00*** | (2017.01) |
| *B31B 120/30* | (2017.01) |
| *B31B 100/00* | (2017.01) |
| *B31B 50/86* | (2017.01) |

(52) U.S. Cl.

CPC ..... *B31B 50/20* (2017.08); *B31B 50/006* (2017.08); *B31B 50/146* (2017.08); *B31B 50/86* (2017.08); *B31B 2100/00* (2017.08); *B31B 2120/302* (2017.08)

(58) Field of Classification Search

CPC ..... B31B 50/20; B31B 50/006; B31B 50/146; B31B 50/86; B31B 2120/302; B31B 2100/00; B31B 50/88; B31B 70/88; B31B 50/59; B31D 5/0043; B31F 2201/07; B31F 2201/0782; B31F 2201/0771; B31F 2201/0774; B31F 2201/0776; B31F 1/07

USPC ..... 493/64

See application file for complete search history.

(56) References Cited

U.S. PATENT DOCUMENTS 3,198,093 A * 8/1965 Kirby ..... B26F 1/384 29/512

6,644,153 B1 * 11/2003 Gordon ..... B26D 7/1818 83/139

(Continued)

*Primary Examiner* — Sameh Tawfik

(74) *Attorney, Agent, or Firm* — Aird & McBurney LP

(57) ABSTRACT

In one aspect, there is provided a combination for use in readying a cutting cylinder is rotatably mounted to a frame in a box-forming production line. The cutting cylinder has a cylinder reference indicium. The combination includes a transfer member with a transfer member reference indicium thereon, a cutting member that includes a base and a cutting blade, and a connector structure that is configured to releasably mount the cutting member to the transfer member. The cutting member is movable to a selected distance along the first axis from the transfer member reference indicium. The connector structure includes a locking structure positionable in an unlocking position for separating the cutting member and the transfer member, and a locking position to lock the connector structure to the transfer member, so as to hold the cutting member at the selected distance from the transfer member reference indicium.

6 Claims, 12 Drawing Sheets

(56) References Cited

U.S. PATENT DOCUMENTS

| | | | | |
|---|---|---|---|---|
| 7,017,463 | B1 * | 3/2006 | Simpson | B26D 7/1818 493/82 |
| 10,759,079 | B2 * | 9/2020 | Smithwick | B26D 7/1818 |
| 11,338,534 | B2 * | 5/2022 | Hedberg | B26F 1/44 |
| 2002/0197346 | A1 * | 12/2002 | Papadopoulos | B31F 1/07 492/38 |
| 2005/0257594 | A1 * | 11/2005 | Hutchison | B26D 7/2628 72/482.93 |
| 2016/0059507 | A1 * | 3/2016 | Kao | B26F 1/20 83/864 |

* cited by examiner

SYSTEM AND METHOD FOR CUTTING SHEETS FOR USE IN THE PRODUCTION OF BOXES

CROSS-REFERENCE TO RELATED APPLICATIONS

This application claims priority to and the benefit of U.S. Provisional Patent Application No. 63/027,504 filed May 20, 2020, the contents of which are incorporated herein in their entirety.

FIELD OF THE DISCLOSURE

The specification relates generally to the manufacture of boxes and in particular corrugated boxes. In particular, the following relates to changing cutting machines over for cutting different boxes.

BACKGROUND OF THE DISCLOSURE

In the corrugated box-making industry, certain types of production equipment are used. For example, the corrugated board is provided in the form of sheets, which are fed to a rotary cutting machine, where cuts are made to the sheets to form hand holes, to form slits for forming folding panels of the box, and to form other box features. The rotary cutting machine includes a shell (typically in the form of two half-shells) which is mounted on a first cylinder. An example of such a shell is shown at 200 in FIGS. 11 and 12. The shell 200 has blades (shown at 202) on it for forming cuts in the sheets, with foam members 204 to push any cut material out from the sheets.

Different customers typically have different needs and employ different designs for their boxes. Accordingly, the placement and size of elements such as hand holes can vary for each run of boxes being produced. Typically, corrugated box manufacturers address this by producing a shell or set of shells for each type of box. When a manufacturing line is to be changed over to produce a different box, the existing shell must be removed from the drums of the rotary die cutters, and replaced with the shell for the new box to be produced. FIG. 7 shows an operator bringing a half-shell to a cylinder 206 of a rotary cutting machine 208, in order to mount the half-shell. This changeover process can be time-consuming. Additionally, the box manufacturer must store the shells, which consumes space and adds to inventory costs.

It would be advantageous to reduce the changeover time for a rotary cutting machine and to address these other problems of space consumption for shells, while still permitting the box producer to produce boxes that have different placements of cuts for different customers.

SUMMARY OF THE DISCLOSURE

In one aspect, there is provided a combination for use in readying a cutting cylinder is rotatably mounted to a frame in a box-forming production line. The cutting cylinder has a cylinder reference indicium. The combination includes a transfer member that has a transfer member reference indicium thereon. The combination further includes a cutting member that includes a base and a cutting blade. The cutting blade is sized to cut through a sheet of box material during counterrotation of the cutting cylinder with a second cylinder as the sheet of box material is fed between the cutting cylinder and the second cylinder. The combination further includes a connector structure configured to releasably mount the cutting member to the transfer member. The cutting member is movable to a selected distance along the first axis from the transfer member reference indicium. The connector structure includes a locking structure that is positionable in an unlocking position in which the cutting member and the transfer member are separable from one another, and a locking position in which the locking structure locks the connector structure to the transfer member so as to hold the cutting member from at least one side of the cutting member at the selected distance from the transfer member reference indicium.

In another aspect, a method is provided for mounting a cutting member on a cutting cylinder having a cylinder reference indicium, wherein the cutting cylinder is rotatably mounted to a frame in a box-forming production line, the method comprising:

a) providing a transfer member, having a transfer member reference indicium thereon;

b) providing a cutting member, wherein the cutting member includes a base and a cutting blade, wherein the cutting blade is sized to cut through a sheet of box material during counterrotation of the cutting cylinder with a second cylinder as the sheet of box material is fed between the cutting cylinder and the second cylinder;

c) mounting the cutting member on the transfer member, at a selected distance from the transfer member reference indicium;

d) positioning the transfer member on the cutting cylinder such that the transfer member reference indicium is aligned with the cylinder reference indicium;

e) mounting the base of the cutting member to the cutting cylinder while the transfer member reference indicium is aligned with the cylinder reference indicium; and f) removing the transfer member from the cutting member after step e).

Other technical advantages may become readily apparent to one of ordinary skill in the art after review of the following figures and description.

BRIEF DESCRIPTIONS OF THE DRAWINGS

For a better understanding of the embodiment(s) described herein and to show more clearly how the embodiment(s) may be carried into effect, reference will now be made, by way of example only, to the accompanying drawings in which.

Figure 1:
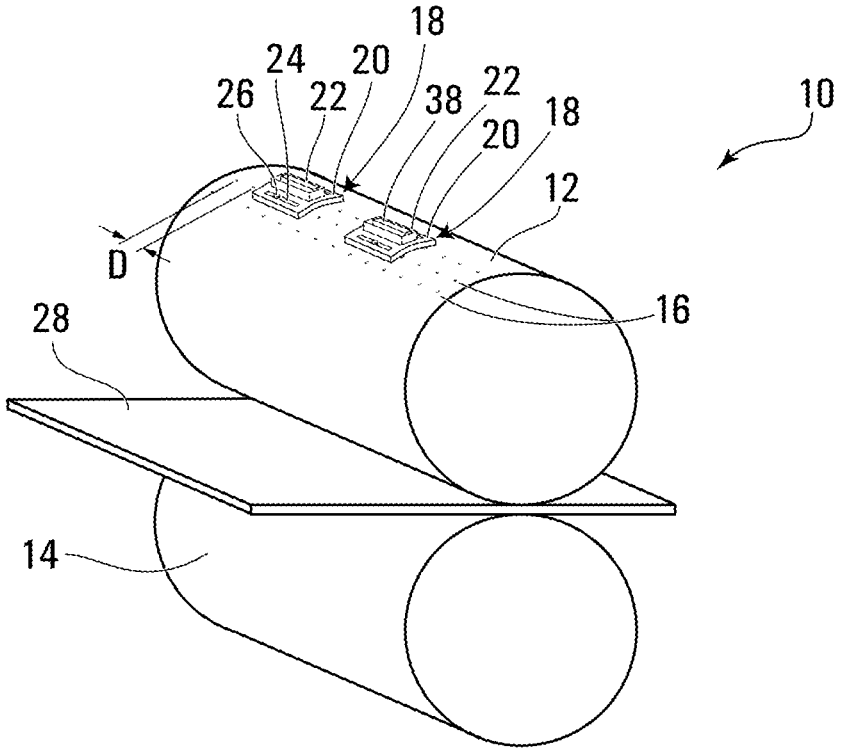
FIG. 1 is a perspective view of a cutting machine used in the manufacture of boxes, in accordance with an embodiment of the present disclosure.

Unless otherwise specifically noted, articles depicted in the drawings are not necessarily drawn to scale.

DETAILED DESCRIPTION

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. It will also be noted that the use of the term "a" will be understood to denote "at least one" in all instances unless explicitly stated otherwise or unless it would be understood to be obvious that it must mean "one".

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Figure 6:
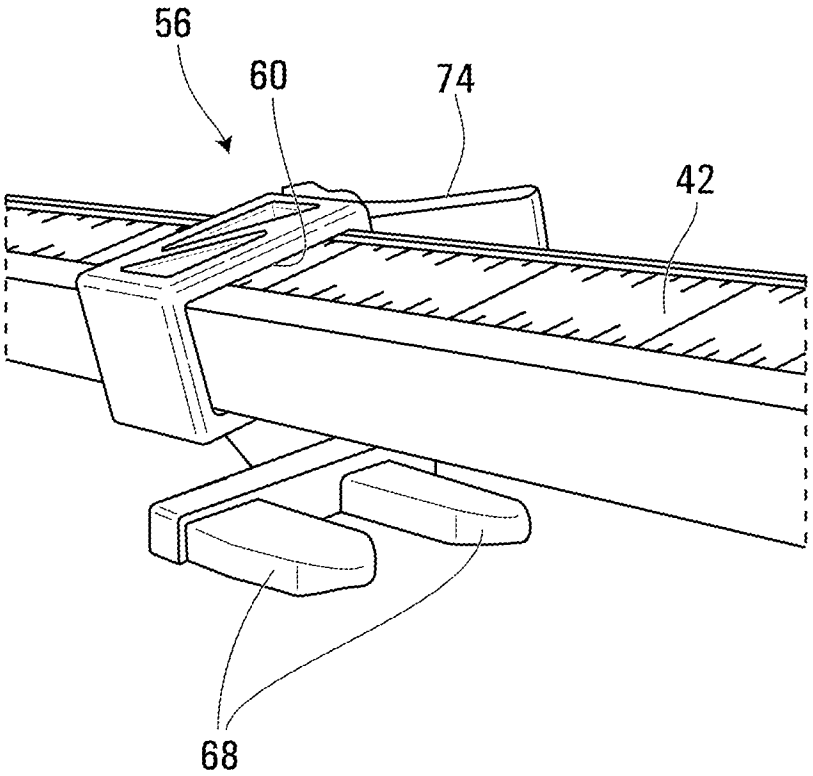
FIG. 6 is a perspective view of a slider that is part of the connector structure shown in FIGS. 3A and 3B.

Reference is made to FIG. 1, which is a schematic representation of a rotary cutting machine 10 in accordance with an embodiment of the present disclosure. The rotary cutting machine 10 includes a cutting cylinder 12, and a second cylinder 14. The cutting cylinder 12 has a plurality of threaded bolt-receiving apertures which are shown at 16. Only three rows of threaded bolt-receiving apertures 16 are shown in FIG. 1, whereas more rows of them are shown in FIGS. 6A and 6B. referring to FIG. 1, a plurality of cutting members 18 are mounted to the cutting cylinder 12.

Figure 5:
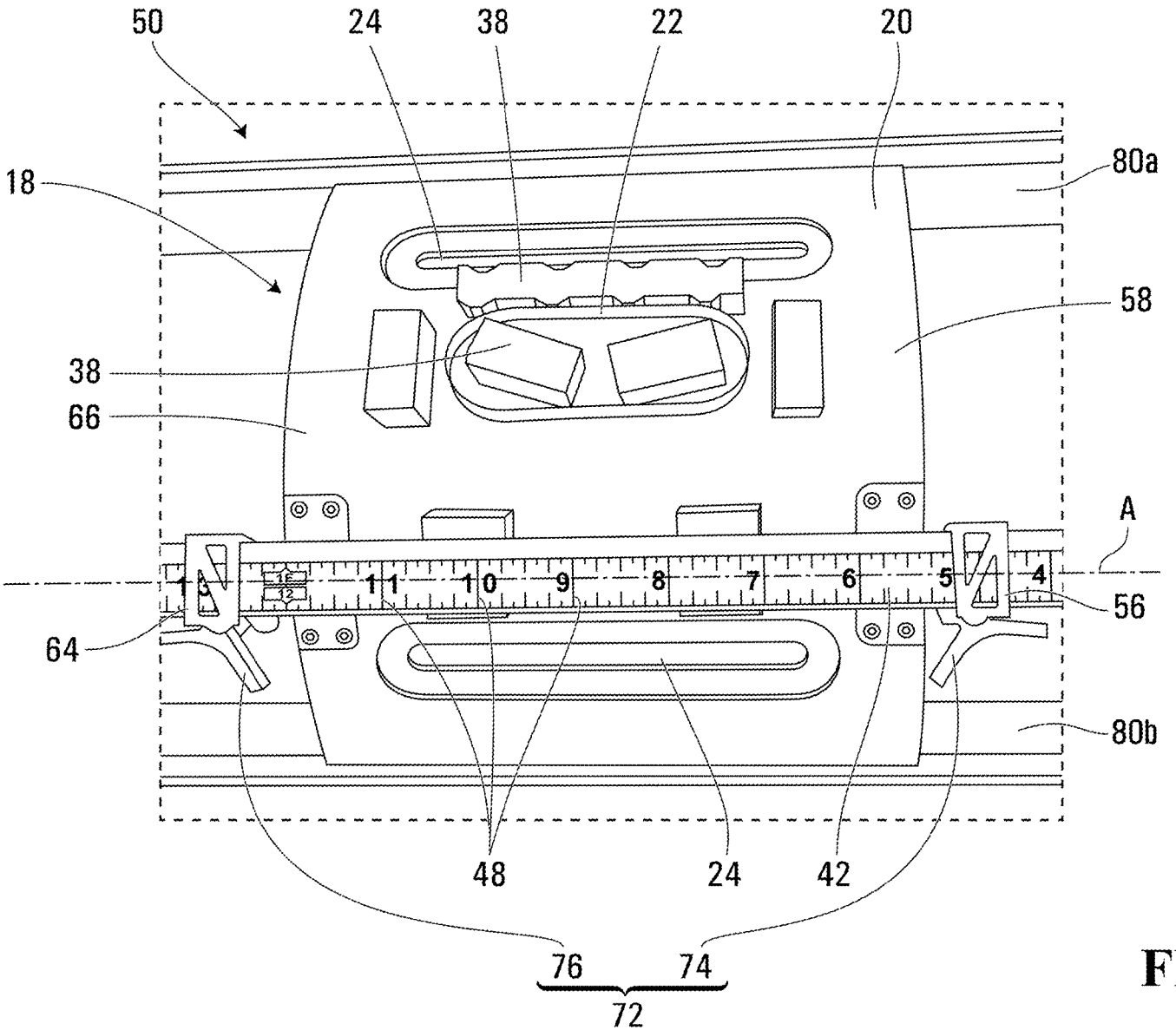
FIG. 5 is a plan view of magnified one of the cutting members shown in FIGS. 3A and 3B, mounted to the transfer member.

Referring to FIG. 5, each cutting member 18 includes a base 20 and a cutting blade 22. The base 20 is used to mount the cutting member 18 to the cutting cylinder 12. More specifically, the base 20 has at least one slotted aperture 24 that is sized to permit the pass-through of at least one bolt shown at 26 into one of the threaded bolt-receiving apertures 16. In the embodiment shown, the bases 20 each include two slotted apertures 24 each of which has one bolt 26 passing therethrough. Preferably, each slotted aperture 24 has a length that is at least the center distance (shown at D in FIG. 1) between two adjacent threaded bolt-receiving apertures 16. For greater certainty, it will be noted that the center distances D need not all be the same.

Figure 2:
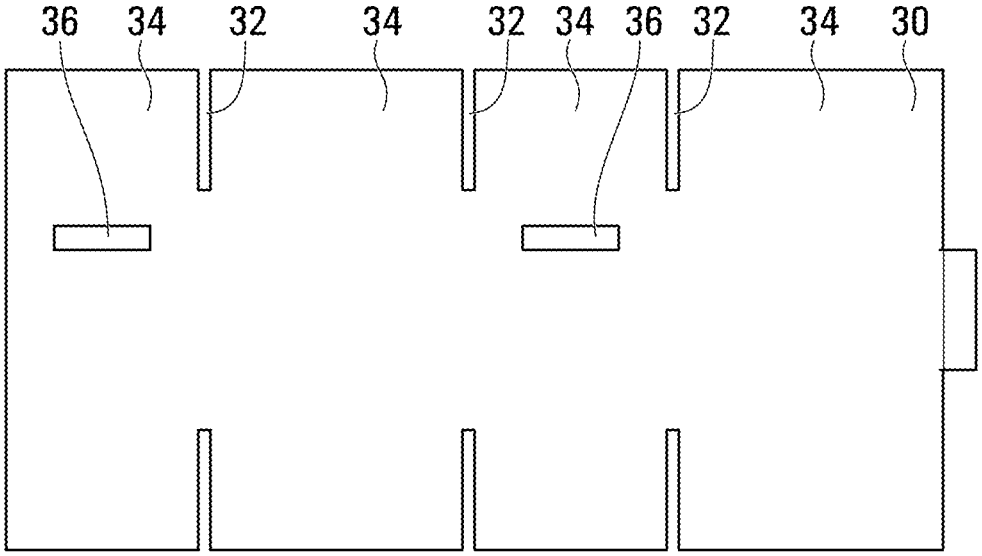
FIG. 2 is a plan view of a sheet that may be produced in the cutting machine shown in FIG. 1.

Referring to FIG. 1, the cutting blade 22 is sized to cut through an input sheet of box material 28 during counter-rotation of the cutting cylinder 12 with the second cylinder 14 as the sheet of box material 28 is fed between the cutting cylinder 12 and the second cylinder 14, as to form a cut sheet of box material 30 (FIG. 2). As shown in FIG. 2, the cut sheet of box material 30 includes a plurality of slits 32 so as to form a plurality of folding panels 34, and a plurality of cuts that form handholes 36. It will be noted that the cutting members that would form the slits 32 are not shown in FIG. 1 in order to simplify the appearance of the cutting cylinder 12.

Optional push out members shown at 38 (FIG. 5) may be provided on the cutting members 18 adjacent to the cutting blade 22. The push out members 38 are compressible, resilient members that are positioned adjacent to the cutting blade 22, so as to apply a force on portions of the input sheet of box material 28 that are cut by the cutting blade 22, in order to push the cut out portions fully or partially from the input sheet of box material 28.

While the input sheet of box material 28 is shown in FIG. 1 as a discrete member, it is alternatively possible that the input sheet of box material 28 is a continuous sheet that is fed to the cutting machine 10. It is possible that the cutting cylinder 12 could include cutting members that are positioned to cut such a continuous sheet into discrete members, in addition to the cuts made to form the slits and the handholes, thereby forming the cut sheet of box material 30 shown in FIG. 2. It is alternatively possible for that cutting operation for cutting the continuous sheet to be performed elsewhere, such as at a downstream cutting machine, or at an upstream cutting machine.

In order to mount the cutting members 18 to the cutting cylinder 12 at selected positions, the cutting cylinder 12 includes a cylinder reference indicium 40, and the cutting members 18 are positioned at selected distances (shown at 19*a* and 19*b* in FIG. 3B) from the cylinder reference indicium 40. To do this, a transfer member 42 and a connector structure 44 (FIGS. 3A and 3B) are provided and configured to releasably mount each cutting member 18 to the transfer member 42.

The transfer member 42 may be an elongate member that extends along a first axis A (FIG. 3A), and has a transfer member reference indicium 46 thereon, which will be used to align with the cylinder reference indicium 40 during mounting of the cutting members 18 to the cutting cylinder 12. In some embodiments, the transfer member 42 includes a plurality of measurement indicia 48 thereon, to indicate a distance of the cutting members 18 from the transfer member reference indicium 46 during mounting of the cutting member on the transfer member.

Figure 4:
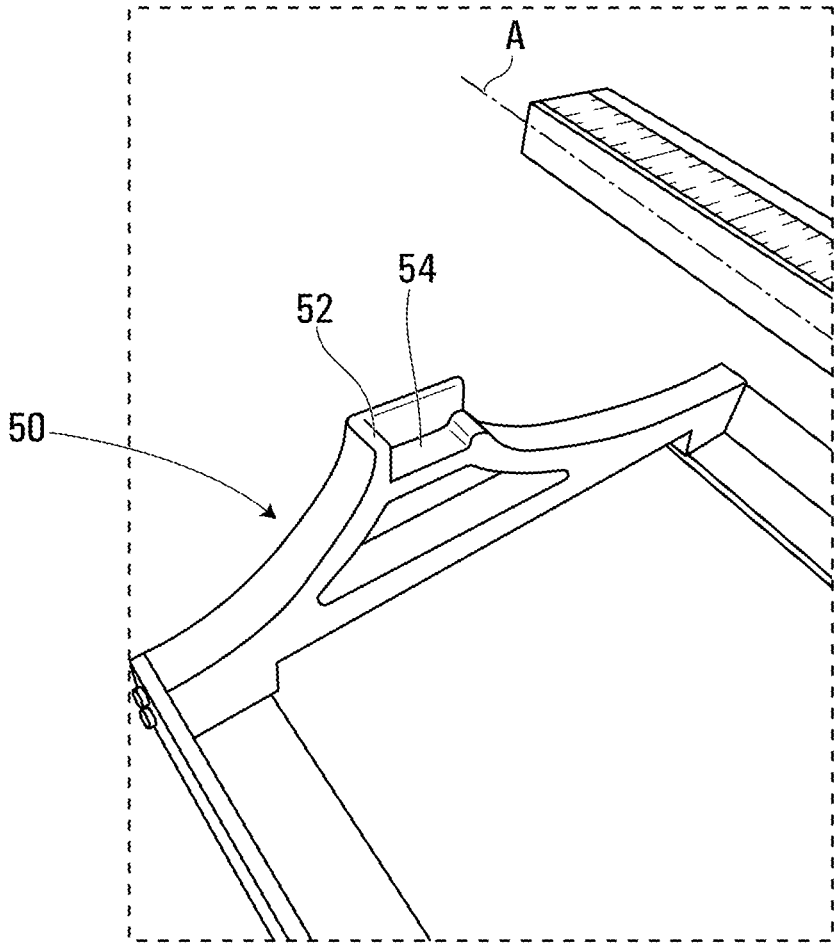
FIG. 4 is a magnified view of an end of a jig that is shown in FIGS. 3A and 3B.

A jig 50 may be provided to assist with the mounting of the cutting members 18 on the transfer member 42. As shown in FIG. 4, the jig 50 includes a transfer member receiving structure 52, that is shaped to receive the transfer member 42 and constrain movement of the transfer member 42 along the first axis A. The transfer member receiving structure 52 may be in the form of a short, closed-end slot 54 or wall at each end of the jig 50. FIG. 4 shows the closed-end slot 54 at one of the ends of the jig 50, however a similar slot 54 is provided at the opposing end of the jig 50.

Figure 7:
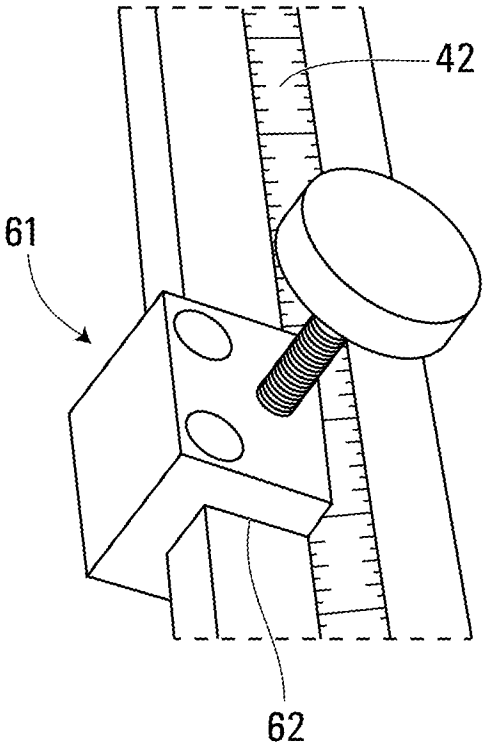
FIG. 7 is a perspective view of an alternative type of slider that can be part of the connector structure shown in FIGS. 3A and 3B instead of the slider shown in FIG. 6.

FIG. 5 shows an example of the connector structure 44. The connector structure 44 in FIG. 5 includes a first slider 56 that is positioned on a first side 58 of the cutting member 18. The first slider 56 is slidably mounted to the transfer member 42 for sliding movement along the first axis A. In the example shown, the first slider 56 includes a loop 60 (FIG. 6) that surrounds the transfer member 42 to slidably mount the first slider 56 to the transfer member 42. Alternatively, a version of the first slider is shown in FIG. 7 at 61 and includes a channel 62 instead of a loop. The channel 62 captures only three sides of the transfer member 42, to slidably mount the first slider 56 to the transfer member 42. Referring to FIG. 5, the connector structure 44 may further include a second slider 64 that is positioned on a second side 66 of the cutting member 18 and which is slidably mounted to the transfer member 42 for sliding movement along the first axis A. The second slider 64 is shown with a loop 60 but it could alternatively be configured similarly to the slider 61 in FIG. 7, or it could have any other suitable structure for a sliding connection to the transfer member 42.

Figure 8A:
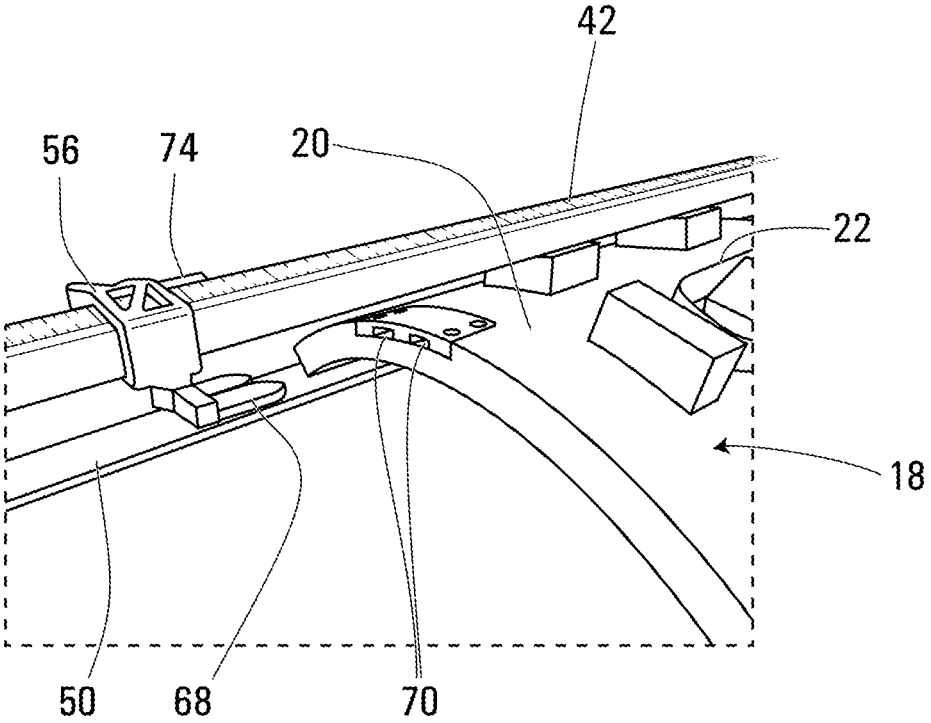
FIG. 8A is a magnified perspective view of the slider shown in FIG. 6, withdrawn from a cutting member.
Figure 8B:
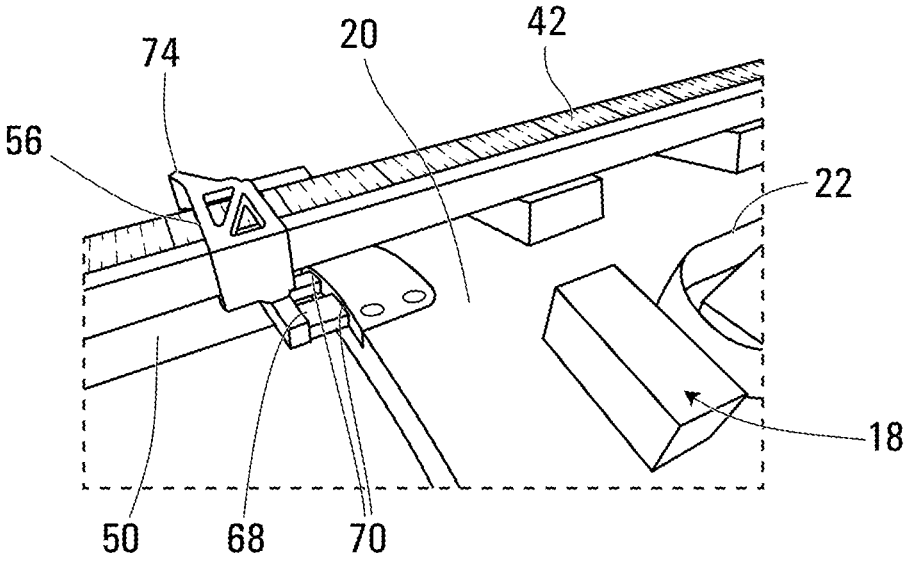
FIG. 8B is a magnified perspective view of the slider shown in FIG. 8A supporting the cutting member shown in FIG. 8A.
Figure 8C:
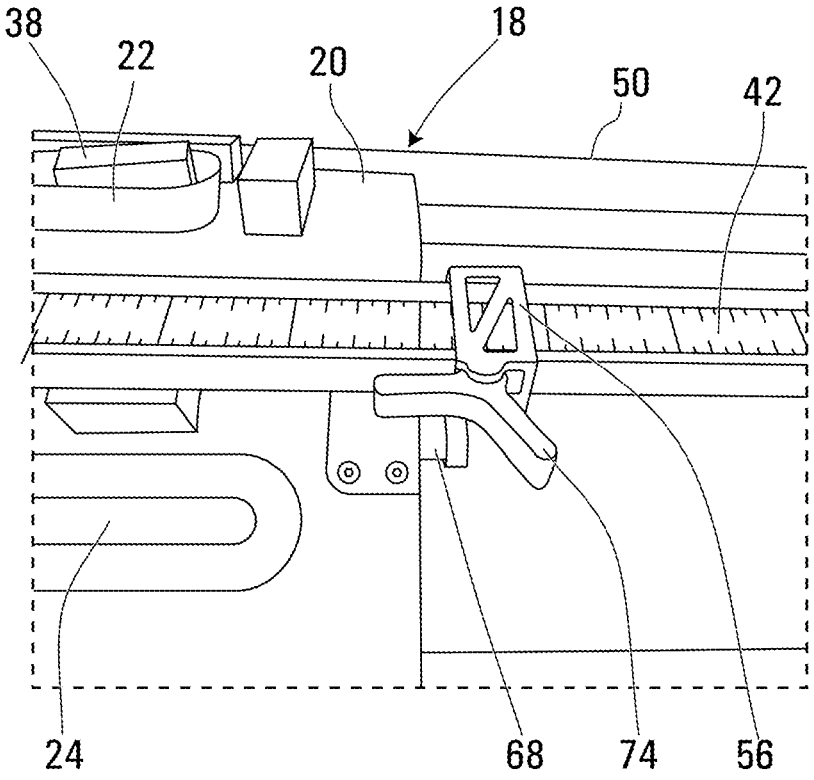
FIG. 8C is a magnified perspective view from another angle of the slider shown in FIG. 8A supporting the cutting member shown in FIG. 8A.

Referring to FIGS. 8A and 8B, each of the first and second sliders 56 and 64 (only the first slider 56 is shown in FIGS. 8A-8C) includes a support member 68 for releasably supporting the cutting member 18. In FIG. 8A, the support member 68 is shown as a two-pronged member for improved stability of the cutting member 18 when supported by the support member 68. In FIG. 8A, the support member 68 is shown withdrawn from the cutting member 18. As can be seen, the cutting member 68 includes support member receiving apertures 70 for receiving the support member 68. In FIG. 8B, the support member 68 is shown as supporting the cutting member 18. The support member 68 in FIG. 8B is only partially inserted into the support member receiving apertures 70, so as to avoid obscuring the receiving apertures 70 in the figure.

The connector structure 44 further includes a locking structure 72 that is positionable in an unlocking position (best seen in FIG. 8C) in which the cutting member 18 and the transfer member 42 are separable from one another, and a locking position (FIG. 5), in which the locking structure 72 locks the connector structure 44 to the transfer member 42, so as to hold the cutting member 18 from at least one side of the cutting member 18 at a selected distance 73 from the transfer member reference indicium 46.

In the example embodiment shown in FIG. 5, the locking structure 72 includes a first locking member 74 mounted to the first slider 56, and a second locking member 76 that is mounted to the second slider 64. The first locking member 74 is movable between a first position (in which the first locking member 74 is unlocked and therefore slidable relative to the transfer member 42) and a second position (in which the first locking member 74 is locked to the transfer member 42). The first locking member 74 is shown in FIGS. 8A-8C in the first position, and in FIG. 5 in the second position. The second locking member 76 may be similar to the first locking member 74 and is movable between a first position (in which the second locking member 76 is unlocked and therefore slidable relative to the transfer member 42) and a second position (in which the second locking member 76 is locked to the transfer member 42). The second locking member 76 is not shown in FIGS. 8A-8C, but would have a mirror image position to that shown for the first locking member 74 therein. The second locking member 76 is shown in FIG. 5 in the second position.

When both the first and second locking members 74 and 76 are in their second positions, the locking structure 72 may be said to be in its locking position. When both the first and second locking members 74 and 76 are in their second positions, as shown in FIG. 5, the sliders 56 and 64 are locked to the transfer member 42 and hold the cutting member 18 from both the first and second sides 58 and 66 at the selected distance from the transfer member reference indicium 46.

In order to facilitate positioning and mounting of the cutting members 18 to the transfer member 42, the jig 50 may further include a cutting member support structure 78, which may be any suitable structure that supports the cutting members 18 in the selected positions from the transfer member reference indicium 46, and/or that support the cutting member 18 during movement of the cutting members 18 along the first axis A to the aforementioned selected positions from the transfer member reference indicium 46. In the example shown, the cutting member support structure 78 includes a pair of rails 80*a* and 80*b*, which support the base 20 of each cutting member 18 (seen best in FIGS. 3B, 5 and 8A).

Figure 3A:
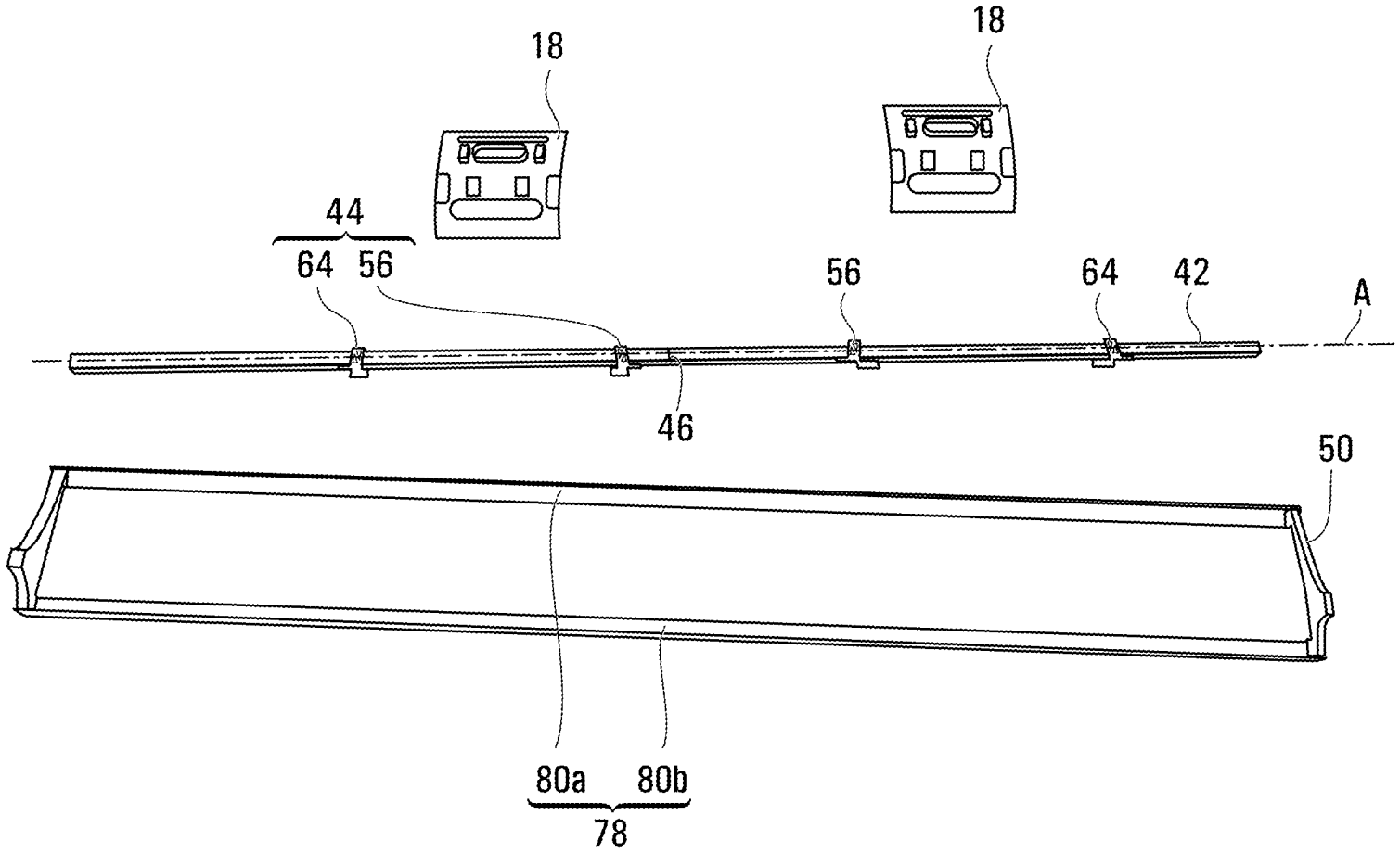
FIG. 3A is an exploded perspective view of a combination of elements, including a jig, a transfer member, a connector structure, and a plurality of cutting members, for use in readying a cutting cylinder as shown in FIG. 1, for operation in a box-production line.
Figure 3B:
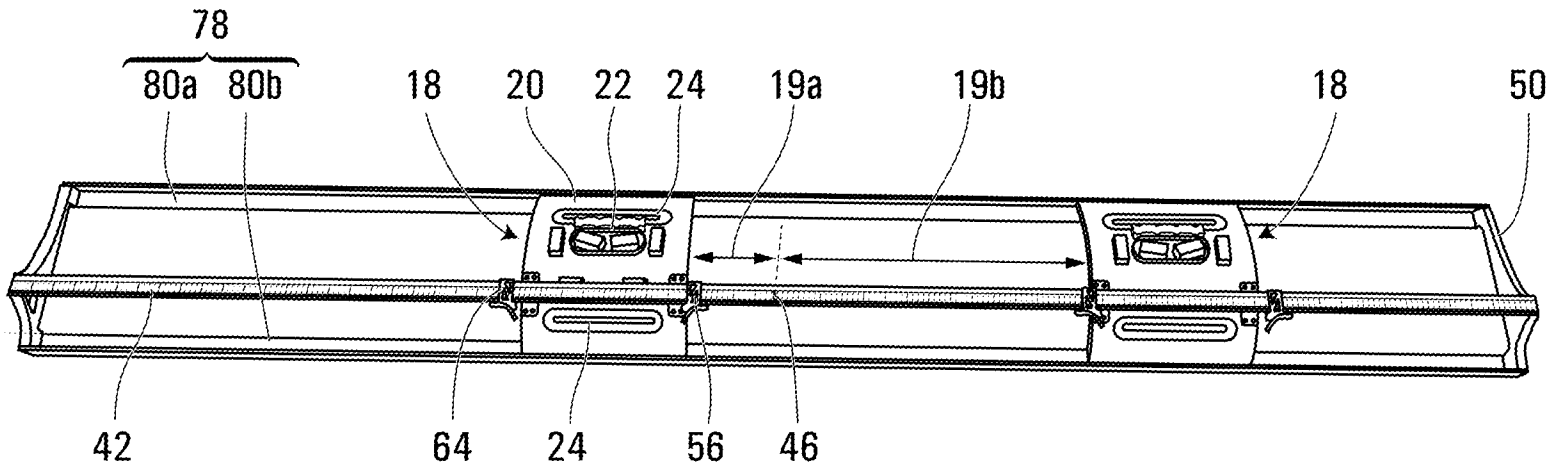
FIG. 3B is a perspective view of the combination shown in FIG. 3, in an assembled state.
Figure 9:
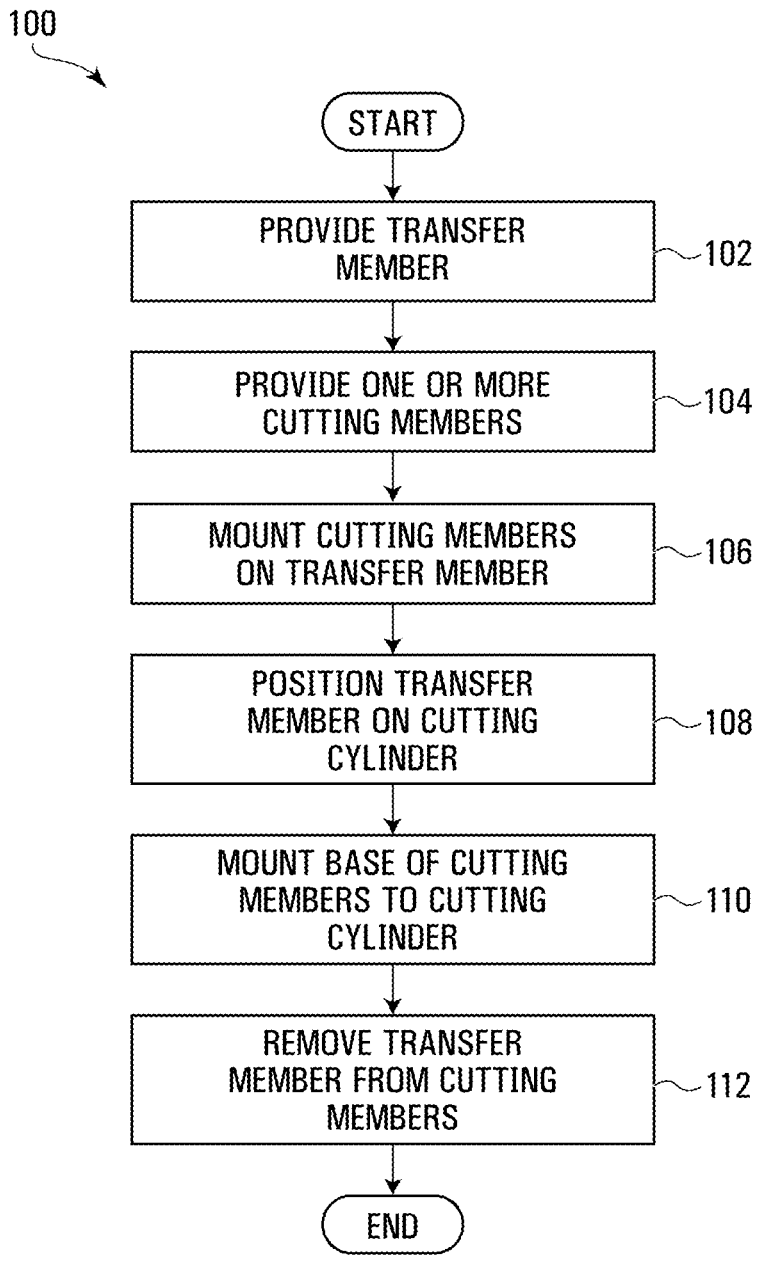
FIG. 9 is a flow diagram illustrating a method for mounting a cutting member on a cutting cylinder, in accordance with another embodiment of the present disclosure.

Using the combination of elements shown in FIGS. 3A and 3B, a method for mounting the cutting members 18 on the cutting cylinder 12 may be as illustrated at 100 in the flow diagram shown in FIG. 9. Step 102 includes providing a transfer member (e.g. the transfer member 42) having a transfer member reference indicium (e.g. the transfer member reference indicium 46) thereon. Step 104 includes providing one or more cutting members (e.g. the cutting members 18), each of which includes a base (e.g. the base 20) and a cutting blade that is sized to cut through a sheet of box material during counterrotation of the cutting cylinder 12 with the second cylinder 14 as the sheet of box material 28 is fed between the cutting cylinder 12 and the second cylinder 14 (e.g. the cutting blade 22). It will be understood that steps 102 and 104 may occur in any order, or even simultaneously, with any amount of overlap between them.

Step 106 includes mounting the cutting member on the transfer member, at a selected distance from the transfer member reference indicium. This step is represented in FIGS. 3B and 5 and may include sliding the cutting members 18 in the jig 50 along the first axis A to a position in which the cutting members are each at their respective selected distances from the transfer member reference indicium 46, and locking the cutting members 18 to the transfer member 42 by moving the locking members 74 on the first and second sliders 56 and 64 to their respective second positions. The transfer member with the cutting members thereon may then be brought over to the cutting cylinder 12 for mounting thereon.

Figure 10:
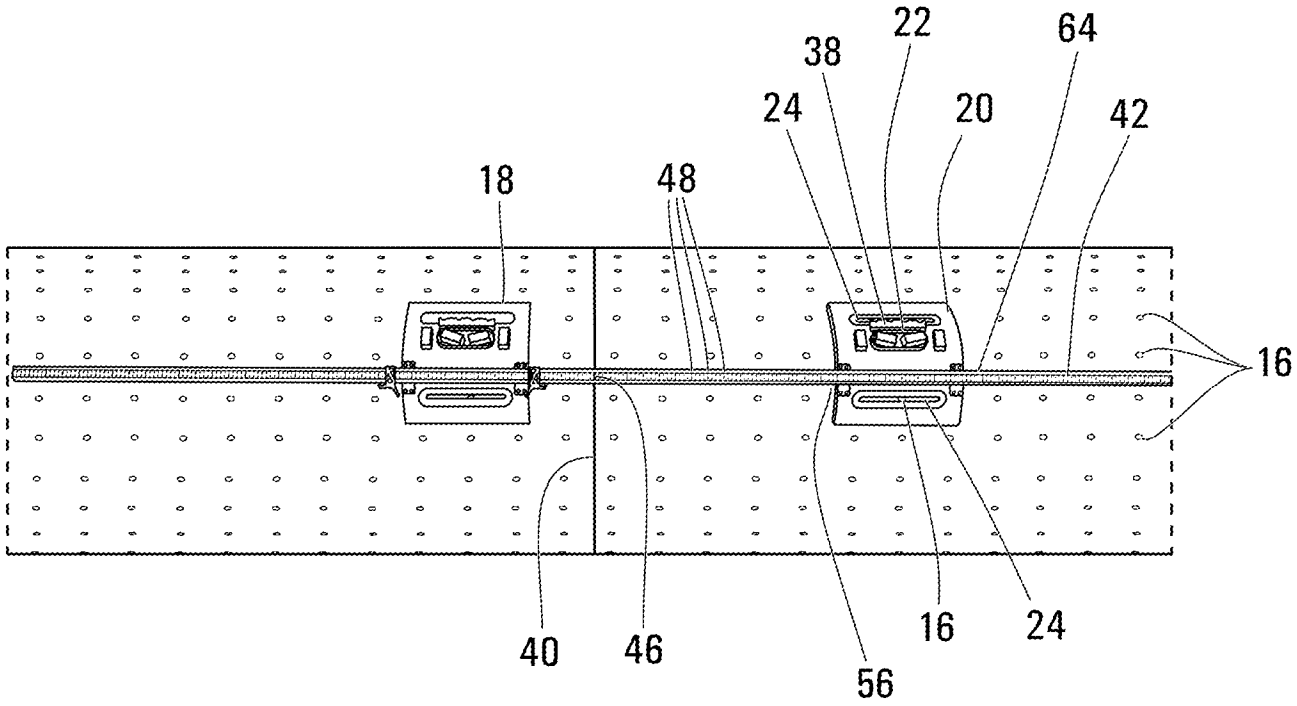
FIG. 10 is a plan view of the cutting members and the transfer member shown in FIG. 3B, positioned on the cutting cylinder.

Step 108 includes positioning the transfer member on the cutting cylinder 12 such that the transfer member reference indicium is aligned with the cylinder reference indicium 40. This step is illustrated in FIG. 10. Step 110 includes mounting the base of the cutting member to the cutting cylinder while the transfer member reference indicium is aligned with the cylinder reference indicium. This may be carried out by installing a bolt 26 (FIG. 1) through the slotted apertures 24 into associated ones of the threaded bolt-receiving apertures 16. Step 112 includes removing the transfer member from the cutting member after step 110. This may include moving the locking structure 72 to the unlocking position (i.e. moving the locking members 74 to their respective first positions, and sliding the first and second sliders 56 and 64 sufficiently to withdraw the support members 68 of the first and second sliders 56 and 64 from supporting the cutting member 18, as shown, for example in FIG. 8A for the first slider 56). Once the support members 68 are withdrawn from the cutting members 18, the transfer member 42 may then simply be lifted away from the cutting members 18 and the cutting cylinder 12.

Figure 11:
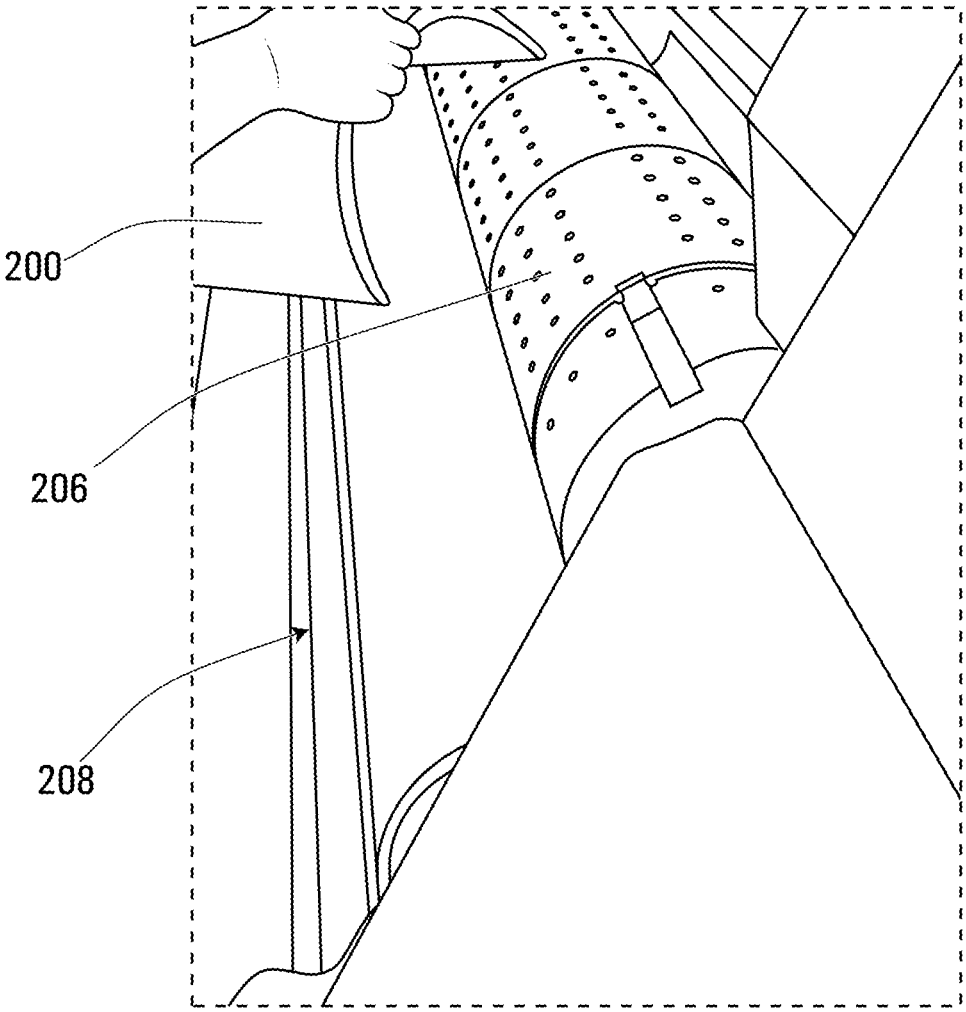
FIG. 11 Prior Art
FIG. 11 is a perspective view of a prior art shell that is being mounted onto a cutting cylinder.
Figure 12:
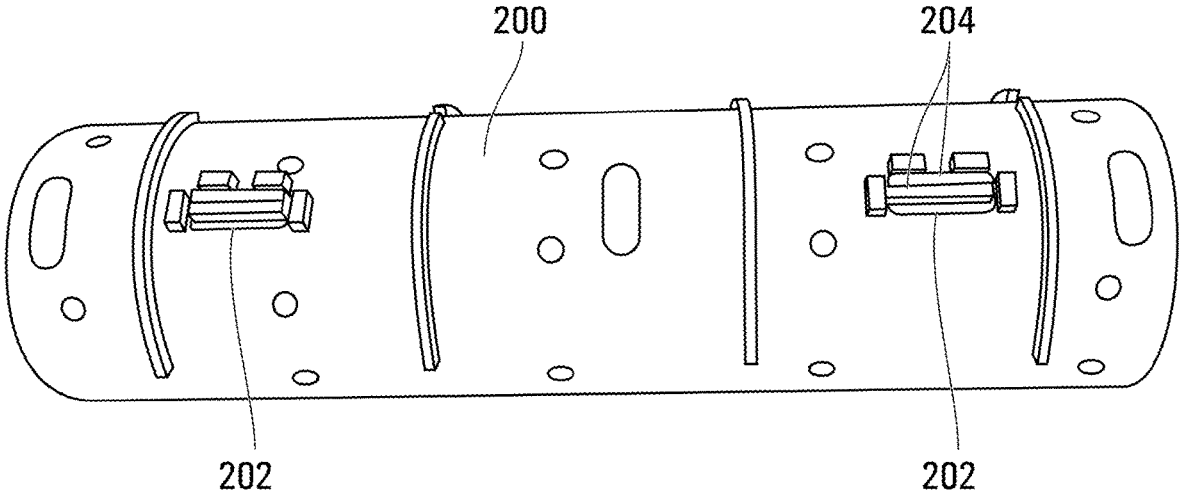
FIG. 12 Prior Art
FIG. 12 is a perspective view of the shell shown in FIG. 11.

By providing the cutting members 18 instead of the shells 200 shown in FIGS. 11 and 12, and by providing the combination of elements shown in FIGS. 3A and 3B, the setup of the cutting machine 10 may be faster and easier than it was previously when changing over to run a new type of box. Additionally, the cutting members 18 employ much less material and may therefore be less expensive than the shells 200.

It will be noted that, while the jig 50 is shown in FIGS. 3A and 3B, the jig 50 may be considered to be an optional item in the combination of elements shown in FIGS. 3A and 3B. It is possible to provide a combination that includes the other elements shown, but that does not include the jig 50.

Although specific advantages have been enumerated above, various embodiments may include some, none, or all of the enumerated advantages.

Persons skilled in the art will appreciate that there are yet more alternative implementations and modifications possible, and that the above examples are only illustrations of one or more implementations. The scope, therefore, is only to be limited by the claims appended hereto and any amendments made thereto.

What is claimed is:

1. A method for mounting a cutting member on a cutting cylinder having a cylinder reference indicium, wherein the cutting cylinder is rotatably mounted to a frame in a box-forming production line, the method comprising:

a) providing a transfer member, having a transfer member reference indicium thereon;

b) providing a cutting member, wherein the cutting member includes a base and a cutting blade, wherein the cutting blade is sized to cut through a sheet of box material during counterrotation of the cutting cylinder with a second cylinder as the sheet of box material is fed between the cutting cylinder and the second cylinder;

c) mounting the cutting member on the transfer member, at a selected distance from the transfer member reference indicium;

d) positioning the transfer member on the cutting cylinder, wherein a transfer member reference indicium is aligned with the cylinder reference indicium;

e) mounting the base of the cutting member to the cutting cylinder while the transfer member reference indicium is aligned with the cylinder reference indicium; and f) removing the transfer member from the cutting member after step e), leaving the cutting member mounted by the base to the cutting cylinder in a selected position relative to the cutting cylinder reference indicium.

2. A method as claimed in claim 1, wherein the transfer member includes a plurality of measurement indicia thereon, to indicate a distance of the cutting member from the transfer member reference indicium during mounting of the cutting member on the transfer member.

3. A method as claimed in claim 1, wherein the base of the cutting member includes a slotted aperture, and the cutting cylinder includes a plurality of threaded bolt-receiving apertures, wherein step d) includes positioning the base of the cutting member such that the slotted aperture passes over at least one of the threaded bolt-receiving apertures and wherein step e) includes passing at least one bolt through the slotted aperture into the at least one bolt-receiving aperture.

4. A method as claimed in claim 1, wherein the cutting member is a first cutting member such that the base is a first base and the cutting member is a first cutting member, and step b) further includes providing a second cutting member which has a second base and a second cutting member, wherein step c) further includes mounting the second cutting member on the transfer member;

and wherein step e) further includes mounting the base of the second cutting member to the cutting cylinder.

5. A method as claimed in claim 1, further comprising:

g) providing a jig;

and wherein step a) includes mounting the transfer member in the jig such that the transfer member is constrained in movement along a first axis on the jig, and wherein step b) includes mounting the cutting member in the jig such that the cutting member is slidable in the jig along the first axis;

and wherein step c) includes sliding the cutting member in the jig along the first axis to a position in which the cutting member is at the selected distance from the transfer member reference indicium, and locking the cutting member to the transfer member.

6. A method as claimed in claim 5, wherein the cutting member includes a loop and a locking member, wherein steps a) and b) further include mounting the cutting member to the transfer member by passing the transfer member through the loop, and wherein locking the cutting member to the transfer member includes moving the locking member from an unlocking position in which the cutting member is slidable relative to the transfer member, to a locking position in which the cutting member is locked to the transfer member, and wherein step f) includes moving the locking member to the unlocking position, and sliding the transfer member out from the loop.

* * * * *